US005551219A

United States Patent [19]

Wei

[11] Patent Number: 5,551,219

[45] Date of Patent: Sep. 3, 1996

[54] PACKAGE BAG EXPANDING DEVICE

[76] Inventor: Yao-ming Wei, No. 11, Alley 22, Lane 227, Chunho St., Chungkung Li Taichung, Taiwan

[21] Appl. No.: 547,501

[22] Filed: Oct. 24, 1995

[51] Int. Cl.[6] ..... B65B 43/14

[52] U.S. Cl. ..... 53/572; 53/384.1; 53/390

[58] Field of Search ..... 53/390, 384.1, 53/570, 571, 572, 255, 288; 248/98, 99, 100

[56] References Cited

U.S. PATENT DOCUMENTS

| | | | |
|---|---|---|---|
| 2,899,788 | 8/1959 | Beebe, Jr. | 53/570 |
| 3,468,100 | 9/1969 | Rukel | 53/572 |
| 3,783,580 | 1/1974 | Raudys | 53/572 |
| 3,896,605 | 7/1975 | Chevalier | 53/570 |
| 4,132,049 | 1/1979 | Mullins, Jr. | 53/384.1 |
| 4,253,292 | 3/1981 | Lipes | 53/572 |
| 4,368,608 | 1/1983 | Ray | 53/572 |
| 4,370,845 | 2/1983 | Perolls et al. | 53/572 |
| 4,791,776 | 12/1988 | Jackman et al. | 53/570 |

*Primary Examiner*—John Sipos
*Assistant Examiner*—Gene L. Kim
*Attorney, Agent, or Firm*—Perman & Green

[57] ABSTRACT

A device is provided for opening at least one package bag which has a first sheet having a first top edge and a second sheet having a second top edge detachably engaged with each other. The device includes a horizontal L-shaped base member. A vertical U-shaped baffle is arranged and has one distal end fixedly attached to a second plate of the base member. At least one horizontal post has one distal end fixedly attached to the baffle, and the top edge of the first sheet of the package bag is mounted around the horizontal post. A pushing member has a vertical section slidably mounted around the horizontal post for urging the first top edge of the first sheet of the package bag to abut on the baffle. A pressing mechanism is mounted on the first plate of the base member and includes a pressing member pivotally mounted thereon. A pressing plate is formed on one end portion of the pressing member and is rested on the second top edge of the second sheet of the package bag.

6 Claims, 7 Drawing Sheets

PACKAGE BAG EXPANDING DEVICE

BACKGROUND OF THE INVENTION

1. Field of Invention

The present invention relates to an expanding device, and more particularly to a device for expanding a package bag such as a paper bag, a vinyl bag and the like.

2. Related Prior Art

People have to use umbrellas for protection on a rain day. However, the droplets on the peripheral surface of the umbrella easily wet and dirty the floor when the user gets to those places such as department stores and the like for shopping or other purposes.

The present invention has arisen to mitigate and/or obviate above-mentioned problem.

SUMMARY OF THE INVENTION

The primary objective of the present invention is to provide a package bag expanding and opening device which is easily operated.

In accordance with one aspect of the present invention, there is provided a device for expanding at least one package bag which has a first sheet having a first top edge and a second sheet having a second top edge detachably engaged with each other. The first top edge is at a level higher than that of the second top edge.

The expanding device comprises a substantially L-shaped base member disposed in a horizontal manner and having a first plate and a second plate. A substantially U-shaped baffle is arranged vertically and in parallel with the first plate of the base member and has two distal ends one of which is fixedly attached to the second plate of the base member and has a first side facing and a second side facing opposite the first plate of the base member.

At least one horizontal post has one distal end fixedly attached to the second side of the baffle and the top edge of the first sheet of the package bag is mounted around the horizontal post. A pushing member includes a vertical section slidably mounted around the horizontal post for urging and moving the first top edge of the first sheet of the package bag to abut on the second side of the baffle.

A pressing mechanism is mounted on the first plate of the base member and includes a pressing member pivotally mounted thereon. A pressing plate is formed on and protrudes outwardly from one distal end portion of the pressing member and is rested on the second top edge of the second sheet of the package bag.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
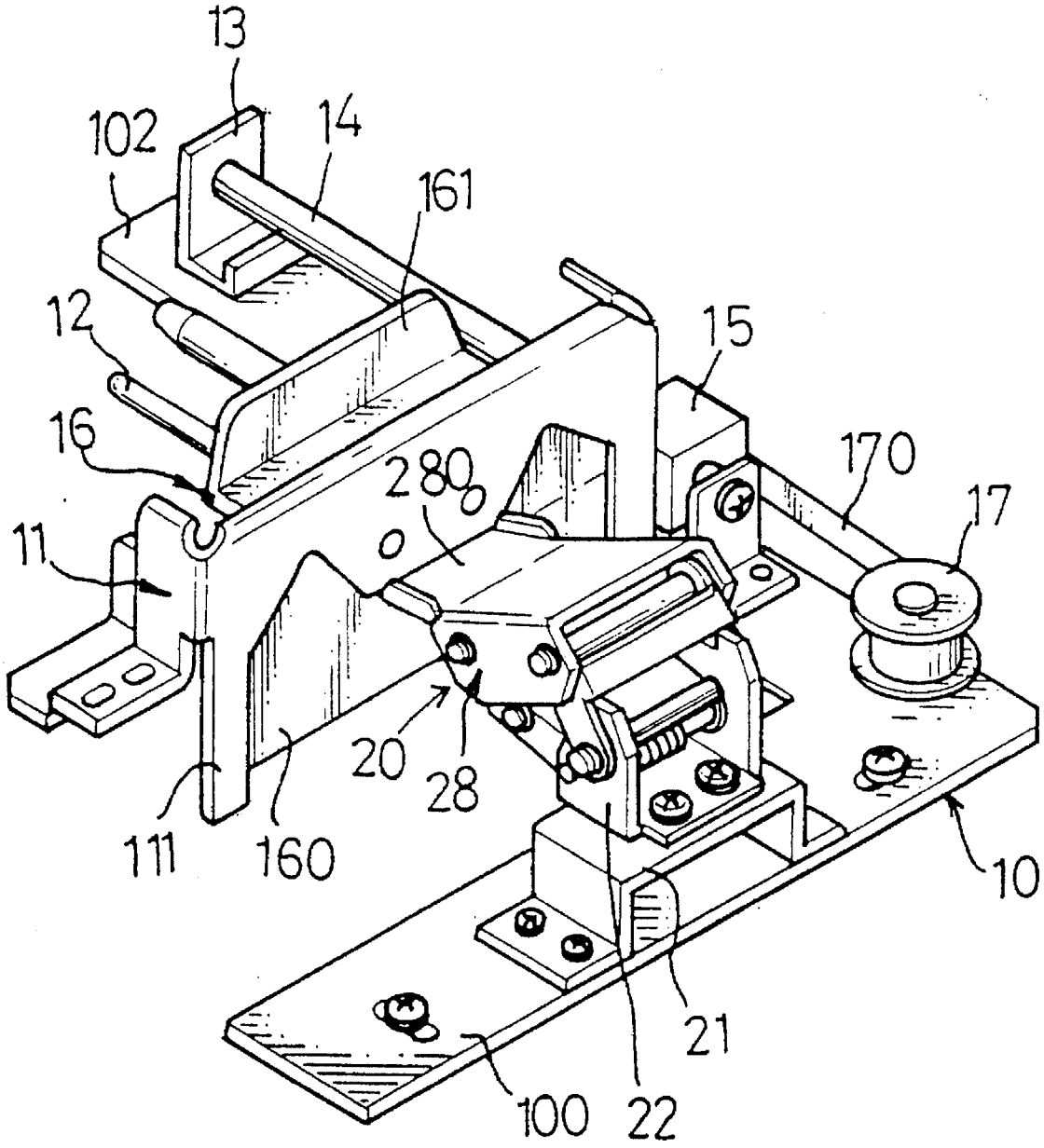
FIG. 1 is a perspective view of a package bag expanding device in accordance with the present invention.
Figure 2:
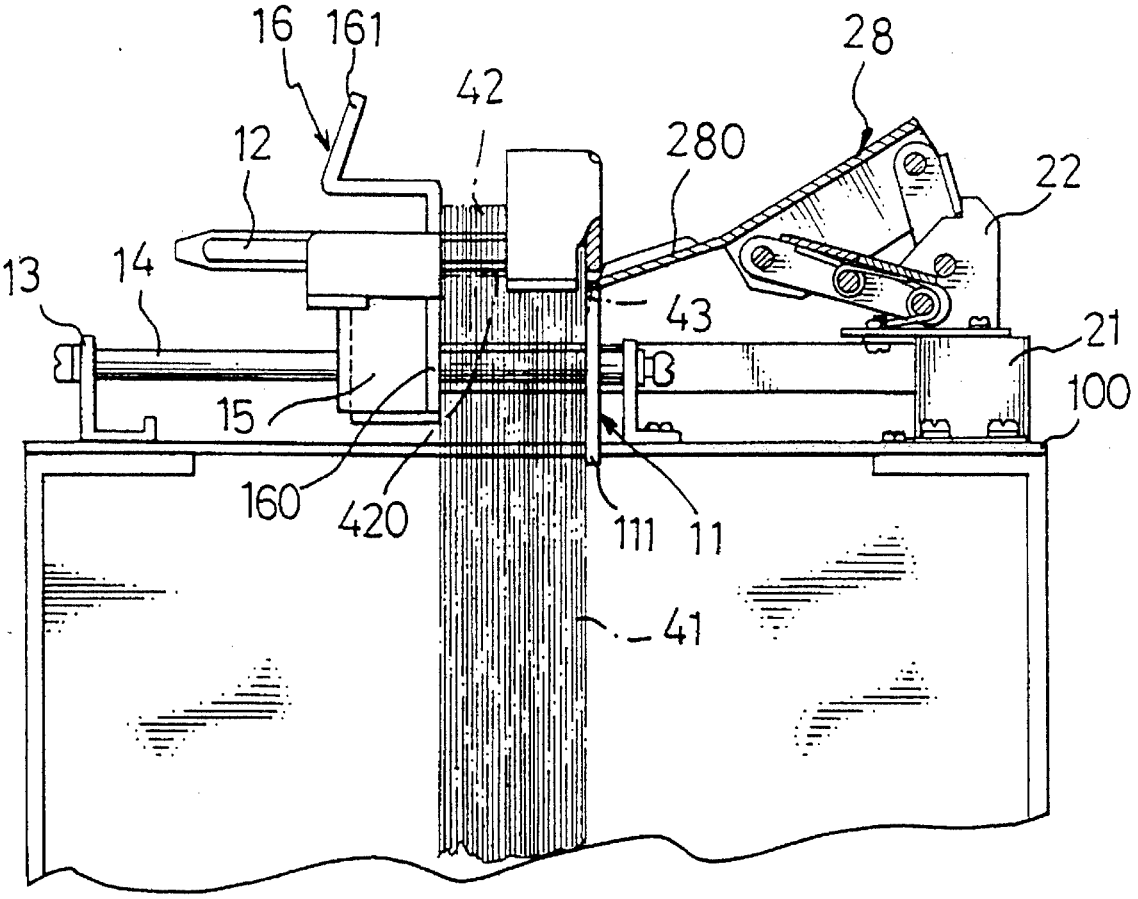
FIG. 2 is a front plan partially cross-sectional view of FIG. 1.
Figure 3:
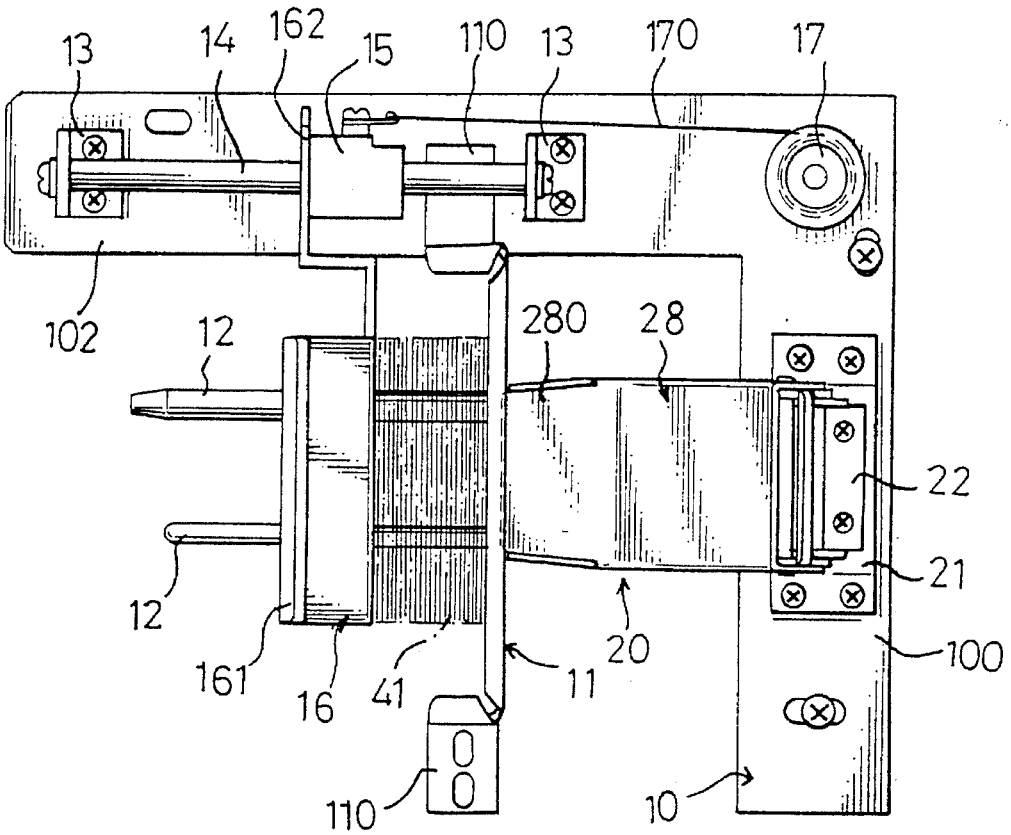
FIG. 3 is a top plan view of FIG. 1.

Referring to the drawings, and initially to FIGS. 1–3, a device in accordance with the present invention is provided for expanding and opening a plurality of package bags 41 such as paper bags, vinyl bags and the like. Each of the plurality of package bags 41 includes a first sheet having a top edge 42 and a second sheet having a second top edge 43 detachably engaged with each other, and the first top edge 42 is at a level higher than that of the second top edge 43, thereby defining an elongated slit (not shown) therebetween.

The expanding device comprises a substantially L-shaped base member 10 which is disposed in a horizontal manner and includes a first plate 100 and a second plate 102 arranged perpendicularly with each other. A substantially U-shaped baffle 11 is arranged vertically and in parallel with the first plate 100 of the base member 10 and has two distal ends 110 one of which is fixedly attached to the second plate 102 of the base member 10 and has a first side facing and a second side facing opposite the first plate 100 of the base member 10.

A plurality of, e.g., two horizontal posts 12 each have one distal end fixedly attached to the second side of the baffle 11, and the top edge 42 of the first sheet of each of the package bags 41 is mounted around the horizontal post 12. Preferably, the top edge 42 of the first sheet of each of the package bags 41 has a through hole 420 defined therein for receiving the horizontal post 12 therein.

A pushing member 16 includes a vertical section 160 slidably mounted around the horizontal post 12 for urging and moving the first top edge 42 of the first sheet of each of the package bags 41 to abut on the second side of the baffle 11. Preferably, each of the two distal ends 110 of the baffle 11 has a vertical extension 111 formed thereon and protruding downwardly therefrom for stopping further movement of the plurality of package bags 41. In addition, a drawing strip 161 is formed on the pushing member 16 in an inclined manner.

There are two substantially L-shaped positioning bases 13 each fixedly mounted on the second plate 102 of the base member 10 and spaced apart from each other. A sliding post 14 is horizontally located above the second plate 102 of the base member 10 and has two distal ends each fixedly attached to a corresponding one of the two positioning bases 13. A movable member 15 is slidably mounted around the sliding post 14.

A steplike extension 162 is laterally formed on and protrudes outwardly from the pushing member 16 and has one distal end fixedly attached to the movable member 15 to move therewith. A return spring 17 is mounted on the second plate 102 of the base member 10, and a flexible strip 170 has a first distal end fixedly attached to the slidable member 15 and a second distal end wound around the return spring 17 to rotate therewith.

A pressing mechanism 20 is mounted on the first plate 100 of the base member 10 and includes a pressing member 28 pivotally mounted thereon. A pressing plate 280 is formed on and protrudes outwardly from one distal end portion of the pressing member 28 and is rested on the second top edge 43 of the second sheet of a first one of the plurality of package bags 41.

Figure 5:
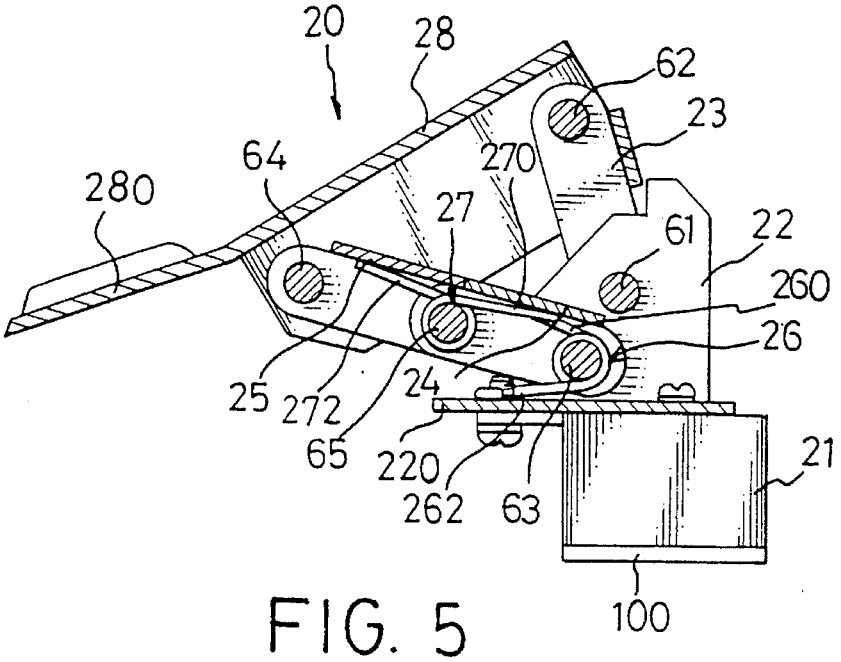
FIG. 5 is a front plan cross-sectional assembly view of FIG. 4.
Figure 4:
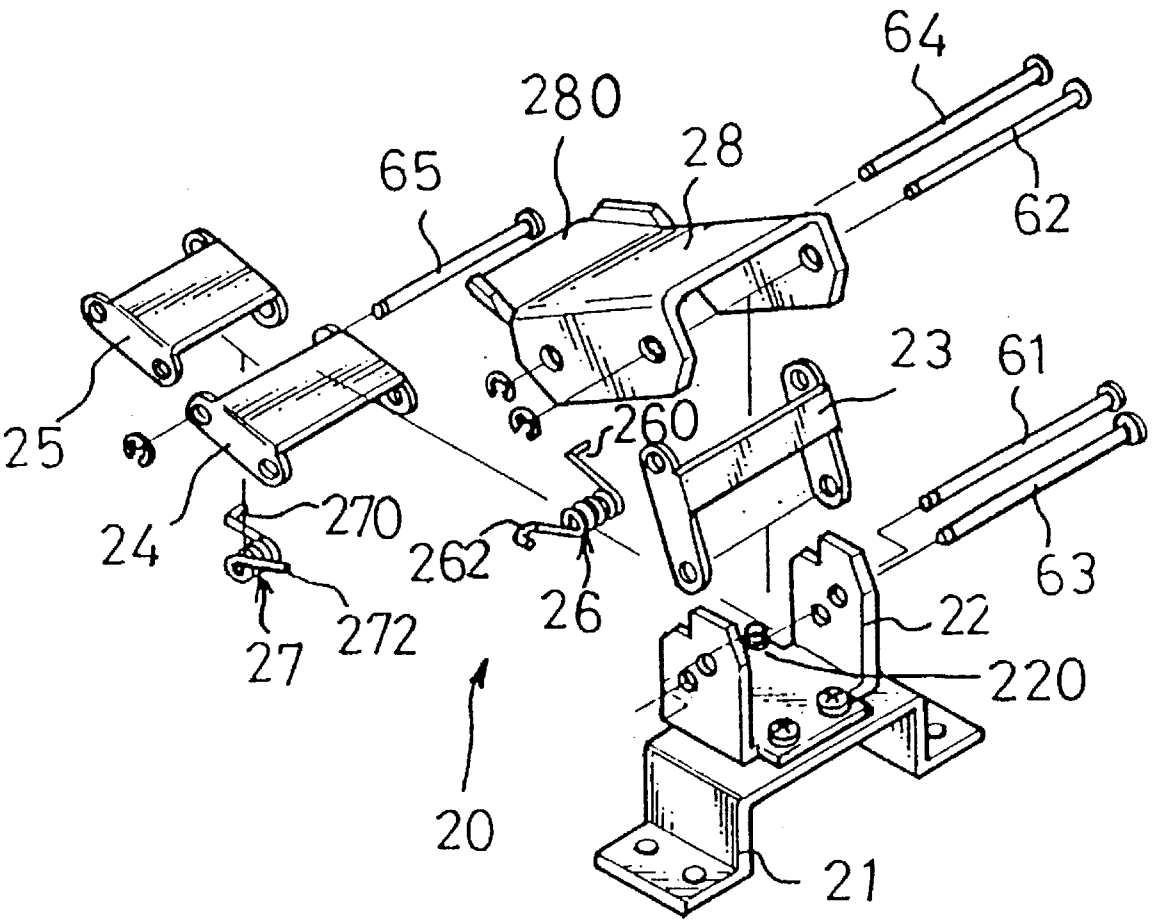
FIG. 4; is a perspective exploded view of a pressing mechanism in accordance with the present invention.

Referring to FIGS. 4 and 5 with reference to FIG. 1, the pressing mechanism 20 comprises a base frame 21 fixedly mounted on the first plate 100 of the base member 10. A substantially U-shaped support bracket 22 is fixedly mounted on the base frame 21. A stop plate 220 is laterally formed on an underside of the support bracket 22 and extends toward the baffle 11.

A linking member 23 includes a first end portion pivotally engaged with an upper portion of the support bracket 22 by means of a pivot axle 61 and a second end portion pivotally engaged with a first end portion of the pressing member 28 by means of a pivot axle 62.

A first urging member 24 includes a first end portion pivotally engaged with a lower portion of the support bracket 22 by means of a pivot axle 63. A second urging member 25 includes a first end portion pivotally engaged with a second end portion of the first urging member 24 by means of a pivot axle 65 and a second end portion pivotally engaged with a second end portion of the pressing member 28.

A first torsional biasing member (or torsional spring) 26 includes a first end portion 260 urged on the first urging member 24 and a second end portion 262 urged on the stop plate 220 of the support bracket 22. A second torsional biasing member (or torsional spring) 27 includes a first end portion 270 urged on the first urging member 24 and a second end portion 272 urged on the second urging member 25.

Figure 6:
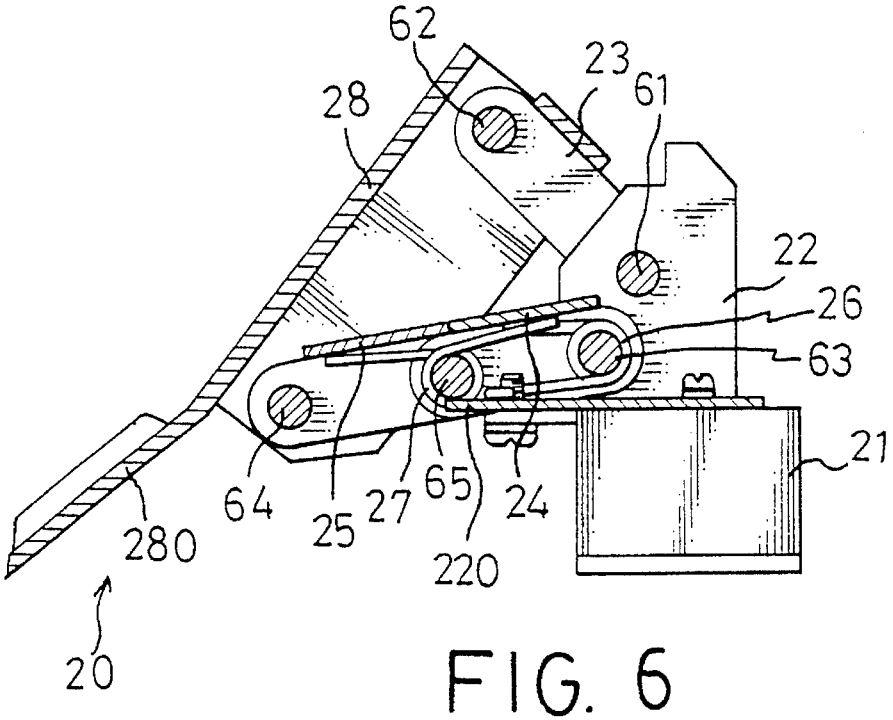
FIGS. 6 and 7 are operational views of FIG. 5.
Figure 7:
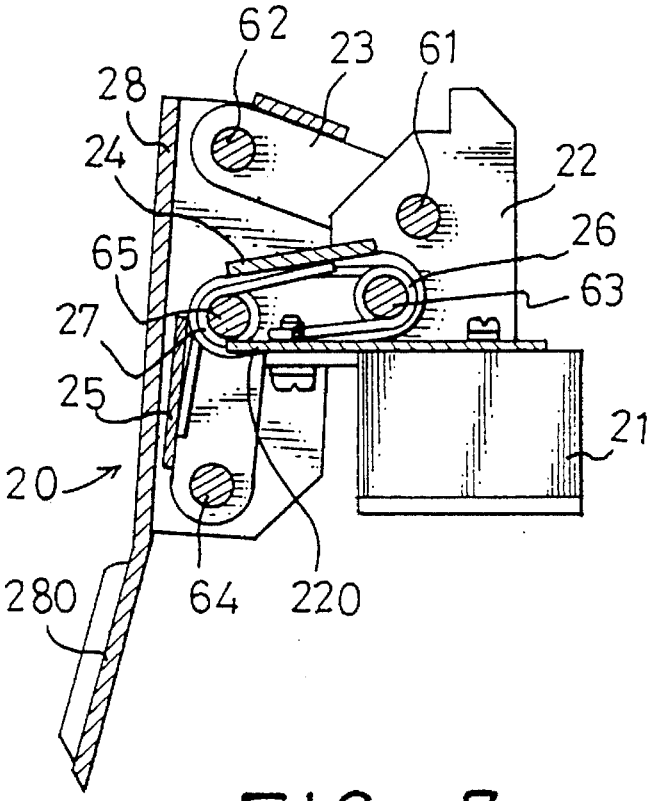

In operation, referring to FIGS. 5–7, when the pressing member 28 is compressed downwardly, the first urging member 24 together with the second urging member 25 is pivoted downwardly about the pivot axle 63 with the first torsional spring 26 being biased and compressed between the first urging member 24 and the stop plate 220 until the movement of the first urging member 24 is stopped by the stop plate 220 as shown in FIG. 6.

When the pressing member 28 is further compressed downwardly, as the first urging member 24 is stopped by the stop plate 220, the second urging member 25 is further pivoted downwardly relative to the first urging member 24 about the pivot axle 65 with the second torsional spring 27 being biased and compressed between the first and second urging members 24 and 25 as shown in FIG. 7.

On the other hand, when the external force exerting on the pressing member 28 is removed, the pressing mechanism 20 will return to the original state as shown in FIG. 5.

Figure 8:
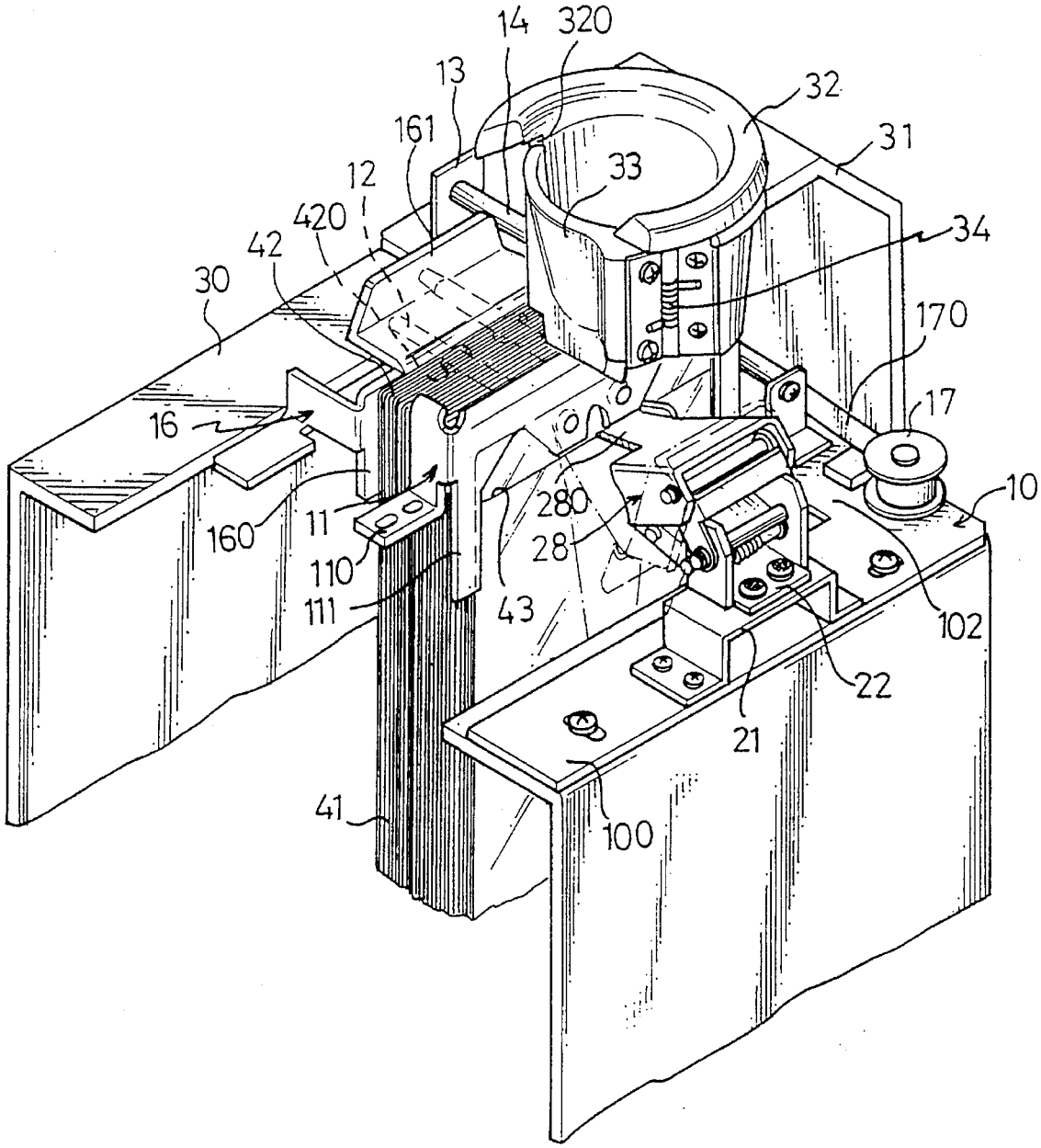
FIG. 8 is a perspective view showing an embodiment of the package bag expanding device.
Figure 9:
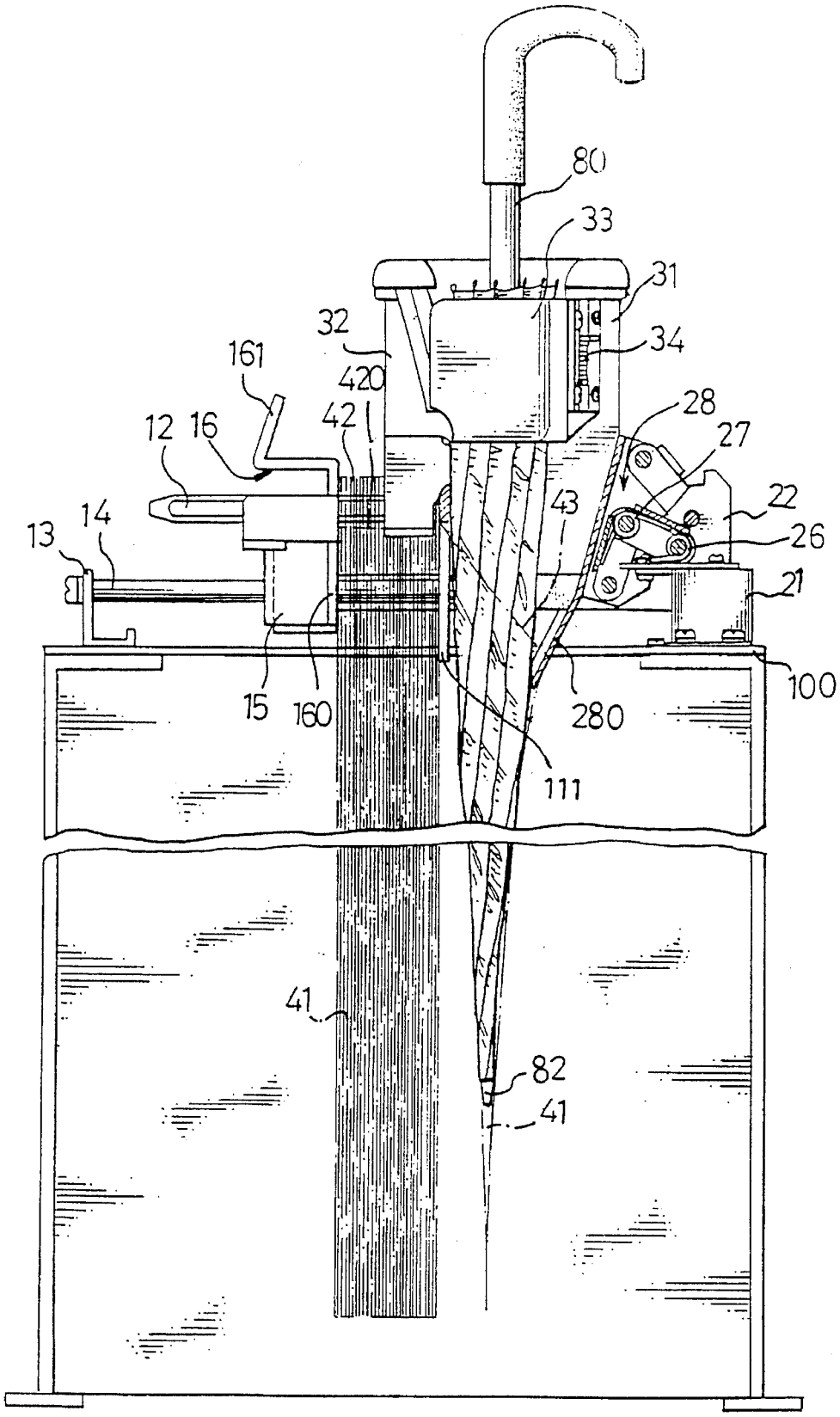
FIG. 9 is a front plan partially cross-sectional view showing an operation of FIG. 8.

In practice, referring to FIGS. 8 and 9, the expanding device in accordance with the present invention can be provided for those places such as department stores and the like. The L-shaped base member 10 is fixedly mounted on a top portion of a casing 30 having an opening (not labeled) defined therein. An L-shaped supporting member 31 includes a vertical section fixedly mounted on the second plate 102 of the base member 10.

A sleeve 32 is fixedly mounted on a horizontal section of the supporting member 31 and is located above the pressing member 28 of the pressing mechanism 20. Preferably, a gap 320 is defined along a periphery of the sleeve 32 for receiving a pivot cap 33 therein which is pivotally engaged with one distal end portion of the sleeve 32 by means of a hinge member 34.

An umbrella 80 can be inserted into the sleeve 32 with a ferrule 82 thereof rested on the pressing member 28, thereby exerting a downward force on the pressing plate 280 which rests on and can in turn separate the second top edge 43 from the first top edge 42 of the first package bag 41 and subsequently shift the second top edge 43 to a position as shown in FIG. 9, thereby separating the second sheet from the first sheet of the first package bag 41, thus expanding and opening the first package bag 41 such that the umbrella 80 can be received in the first package bag 41, so preventing the droplets on the wet umbrella 80 from wetting the floor of the department store.

When the wet umbrella 80 has already been enclosed in the first package bag which is subsequently torn down at the first top edge 42 thereof, the pivot cap 33 is then opened such that the packed umbrella 80 can be taken from the sleeve 32, thereby accomplishing the packing action of the umbrella 80.

The package bags 41 remaining on the horizontal post 12 can be urged to move forward towards the baffle 11 by means of the return spring 17 forcing the vertical section 160 of the pushing member 16 to displace forward. In the meantime, the pressing mechanism 20 can be returned to its original status as shown in FIG. 8 by means of the returning action of the first and second torsional springs 26 and 27 such that the above-described packing action of the umbrella can be performed again.

It should be clear to those skilled in the art that further embodiments of the present invention may be made without departing from the teachings of the present invention.

What is claimed is:

1. A device for expanding at least one package bag (41) which has a first sheet having a first top edge (42) and a second sheet having a second top edge (43) detachably engaged with each other, said first top edge (42) being at a level higher than that of said second top edge (43), said device comprising:

a substantially L-shaped base member (10) disposed in a horizontal manner and having a first plate (100) and a second plate (102);

a substantially U-shaped baffle (11) arranged vertically and in parallel with said first plate (100) of said base member (10) and having two distal ends (110) one of which is fixedly attached to said second plate (102) of said base member (10) and having a first side facing and a second side facing opposite said first plate (100) of said base member (10);

at least one horizontal post (12) having one distal end fixedly attached to the second side of said baffle (11), the first top edge (42) of the first sheet of said package bag (41) being mounted around said horizontal post (12);

a pushing member (16) including a vertical section (160) slidably mounted around said horizontal post (12) for urging and moving the first top edge (42) of the first sheet of said package bag (41) to abut on the second side of said baffle (11); and a pressing mechanism (20) mounted on said first plate (100) of said base member (10) and including a pressing member (28) pivotally mounted thereon and having a first end portion and a second end portion, a pressing plate (280) formed on and protruding outwardly from the second end portion of said pressing member (28) and rested on the second top edge (43) of the second sheet of said package bag (41).

2. The device in accordance with claim 1, wherein said pressing mechanism (20) comprises a base frame (21) fixedly mounted on said first plate (100) of said base member (10), a support bracket (22) fixedly mounted on said base frame (21), a stop plate (220) formed on an underside of said support bracket (22) and extending toward said baffle (11), a linking member (23) including a first end portion pivotally engaged with an upper portion of said support bracket (22) and a second end portion pivotally engaged with the first end portion of said pressing member (28), a first urging member (24) having a first end portion pivotally engaged with a lower portion of said support bracket (22) and a second end portion, a second urging member (25) having a first end portion pivotally engaged with the second end portion of said first urging member (24) and a second end portion pivotally engaged with the second end portion of said pressing member (28), a first torsional biasing member (26) having a first end portion (260) urged on said first urging member (24) and a second end portion (262) urged on said stop plate (220), and a second torsional biasing member (27) having a first end portion (270) urged on said first urging member (24) and a second end portion (272) urged on said second urging member (25).

3. The device in accordance with claim 1, further comprising two positioning bases (13) each fixedly mounted on said second plate (102) of said base member (10) and spaced apart from each other, a sliding post (14) horizontally located above said second plate (102) of said base member (10) and having two distal ends each fixedly attached to a corresponding one of said two positioning bases (13), a movable member (15) slidably mounted around said sliding post (14), an extension (162) laterally formed on and protruding outwardly from said pushing member (16) and fixedly attached to said movable member (15) to move therewith.

4. The device in accordance with claim 3, further comprising a return spring (17) mounted on said second plate (102) of said base member (10), and a flexible strip (170) having a first distal end fixedly attached to said slidable member (15) and a second distal end wound around said return spring (17) to rotate therewith.

5. The device in accordance with claim 1, further comprising an L-shaped supporting member (31) having a vertical section fixedly mounted on said second plate (102) of said base member (10) and a horizontal section, and a sleeve (32) fixedly mounted on said horizontal section of said supporting member (31) and located above said pressing member (28) of said pressing mechanism (20).

6. The device in accordance with claim 1, wherein each of the two distal ends (110) of said baffle (11) has a vertical extension (111) formed thereon and protruding downwardly therefrom.

* * * * *